US010815090B2

(12) United States Patent
Sale

(10) Patent No.: US 10,815,090 B2
(45) Date of Patent: Oct. 27, 2020

(54) PROCESSING APPARATUS

(71) Applicant: MANZ ITALY S.R.L., Sasso Marconi (IT)

(72) Inventor: Massimiliano Sale, Sasso Marconi (IT)

(73) Assignee: Manz Italy S.r.l. (IT)

( * ) Notice: Subject to any disclaimer, the term of this patent is extended or adjusted under 35 U.S.C. 154(b) by 0 days.

(21) Appl. No.: 16/327,494

(22) PCT Filed: Aug. 30, 2017

(86) PCT No.: PCT/IB2017/055207
§ 371 (c)(1),
(2) Date: Feb. 22, 2019

(87) PCT Pub. No.: WO2018/055465
PCT Pub. Date: Mar. 29, 2018

(65) Prior Publication Data

US 2019/0168980 A1 Jun. 6, 2019

(30) Foreign Application Priority Data

Sep. 20, 2016 (IT) ..... 102016000094439

(51) Int. Cl.
*B65H 20/06* (2006.01)
*B26D 1/60* (2006.01)
(Continued)

(52) U.S. Cl.
CPC ..... *B65H 20/06* (2013.01); *B26D 1/605* (2013.01); *B26D 5/20* (2013.01);
(Continued)

(58) Field of Classification Search
CPC ... Y10T 83/04; Y10T 83/0515; Y10T 83/051; Y10T 83/2192; Y10T 83/2194;
(Continued)

(56) References Cited

U.S. PATENT DOCUMENTS 3,238,826 A * 3/1966 Crispe ..... B65G 21/14 83/65
4,429,602 A 2/1984 Vits
(Continued)

FOREIGN PATENT DOCUMENTS

| | | | |
|---|---|---|---|
| DE | 3517264 | A1 | 3/1986 |
| DE | 10102073 | A1 | 7/2002 |
| WO | 2012110915 | A1 | 8/2012 |

*Primary Examiner* — Phong H Nguyen
(74) *Attorney, Agent, or Firm* — Laubscher & Laubscher, P.C.

(57) ABSTRACT

A processing apparatus is disclosed comprising a shearing unit that receives the material to be processed from a conveying device upstream and surrenders it to a conveying device downstream, in which the material to be sheared advances with a continuous supply motion, in which each conveying device comprises a variable geometry closed loop slidable flexible element, in which the shearing unit is constrained to move with alternating motion together with two movable portions of the two conveying devices. The apparatus can process web-shaped material for the production of electrical energy storage devices.

18 Claims, 3 Drawing Sheets

(51) Int. Cl.
*B26D 5/20* (2006.01)
*B26D 1/00* (2006.01)

(52) U.S. Cl.
CPC ..... *B26D 2001/0066* (2013.01); *B65H 2301/51538* (2013.01); *B65H 2403/55* (2013.01); *B65H 2404/2532* (2013.01); *B65H 2404/2614* (2013.01); *B65H 2404/2615* (2013.01); *B65H 2404/68* (2013.01); *B65H 2405/52* (2013.01); *B65H 2801/72* (2013.01)

(58) Field of Classification Search
CPC ... Y10T 83/39; Y10T 83/463; Y10T 83/4734; Y10T 83/4757; Y10T 83/49; Y10T 83/465; Y10T 83/4728; B65H 20/00; B65H 20/06; B65H 29/12; B65H 2301/51538; B65H 2301/00; B65H 2301/4473; B65H 2301/515; B65H 2403/20; B65H 2403/55; B65H 2404/2532; B65H 2404/2614; B65H 2404/2615; B65H 2404/68; B65H 2404/261; B65H 2404/2613; B65H 2405/52; B65H 2405/50; B65H 2801/72; B26D 1/605; B26D 1/56; B26D 1/60; B26D 5/20; B26D 2001/0066; B65G 1/14
USPC ..... 198/812
See application file for complete search history.

(56) References Cited

U.S. PATENT DOCUMENTS

| | | | | |
|---|---|---|---|---|
| 6,125,205 | A * | 9/2000 | Rivoallon | G06T 7/0006 382/180 |
| 7,766,158 | B2 * | 8/2010 | Laganiere | A01D 57/20 198/312 |
| 8,281,631 | B1 | 10/2012 | Chen | |
| 2008/0185095 | A1 * | 8/2008 | Gutknecht | B29D 30/42 156/304.1 |
| 2011/0005894 | A1 * | 1/2011 | Tsai | B65H 31/3009 198/358 |
| 2013/0000454 | A1 * | 1/2013 | Miller | B26D 1/60 83/37 |
| 2016/0130107 | A1 | 5/2016 | Allen, Jr. et al. | |

* cited by examiner

PROCESSING APPARATUS

CROSS-REFERENCE TO RELATED APPLICATIONS

This application is a § 371 National Stage Entry of PCT International Application No. PCT/IB2017/055207 filed Aug. 30, 2017. PCT/IB2017/055207 claims priority of Italian Application No. 102016000094439 filed Sep. 20, 2016. The entire content of these applications is incorporated herein by reference.

BACKGROUND OF THE INVENTION

The invention relates to a processing apparatus, in particular for processing material (for example in the form of a continuous web) that advances with a continuous supply motion.

Specifically, but not exclusively, the invention can be applied to the production of electrical energy storage devices.

One of the problems of the prior art is to provide an apparatus that is suitable for processing material, which advances with a continuous supply motion, without interrupting the continuity of supply. Patent publication WO 2012/110915 A1 shows an example of a solution to the aforesaid problem.

SUMMARY OF THE INVENTION

One object of the invention is to make available an alternative solution to the aforesaid problem of the prior art.

One advantage is to solve the aforesaid problem by a processing apparatus with relatively high productivity.

One advantage is to obtain a processing apparatus of relatively compact dimensions in the material advancement direction.

One advantage is to enable material to be processed that advances at a relatively high supplying speed.

One advantage is to permit indexed processing to be performed, on material that advances with a continuous supply motion, in which the processing step can be relatively reduced.

One advantage is to make a processing apparatus that is usable for the production of electrical energy storage devices.

One advantage is to provide a processing apparatus that is constructionally simple and cheap and highly reliable.

One advantage is to give rise to a processing apparatus that is suitable for processing material in the form of a continuous web.

One advantage is to permit processing in which a material in the form of a continuous web is separated into a plurality of discrete portions.

One advantage is to provide a processing apparatus that is able to perform shearing of material in the form of a continuous web.

Such objects and advantages and still others are achieved by an apparatus and/or by a method according to one or more of the claims set out below.

In one embodiment, a processing apparatus comprises at least one conveying device with a closed loop slidable flexible element, in which the conveying device comprises at least one movable portion the movement of which enables the geometry of the closed loop to be varied, in which the processing apparatus comprises a processing unit arranged for receiving the material to be processed from the conveying device, in which the processing unit is constrained to move together with the aforesaid moveable portion of the conveying device with an alternating forward and return movement.

The processing apparatus may operate with a work cycle that comprises at least one forward step in which the processing unit advances in the same continuous advancement direction as the material and in which the processing unit engages the material during at least one part of the forward step.

The processing unit may advance at the same continuous advancement speed as the material whilst it engages the material.

During advancement of the processing unit in the forward step, the moveable portion of the conveying device may be moved together (at the same speed) with the processing unit, varying the geometry of the closed loop. The conveying device may comprise an outlet for the material (through which the material is surrendered to the processing unit) in which this outlet, during advancement of the processing unit in the forward step, can be moved together with the processing unit so as to remain at the same distance from the processing unit.

The work cycle may comprise at least one return step in which the processing unit (by disengaging the material) goes back in an opposite direction to the material advancement direction to return to the initial position and start a new cycle. During the going back in the return step, the moveable portion of the conveying device moves together (at the same speed) with the processing unit, varying the geometry of the closed loop. The conveying device may comprise an outlet for the material (through which the material is surrendered to the processing unit) in which this outlet, during the going back of the processing unit in the return step, may be moved together with the processing unit in such a manner as to be at the same distance from the processing unit.

BRIEF DESCRIPTION OF THE DRAWINGS

The invention can be better understood and implemented with reference to the attached drawings that illustrate embodiments thereof by way of non-limiting example, in which.

DETAILED DESCRIPTION

Figure 1:
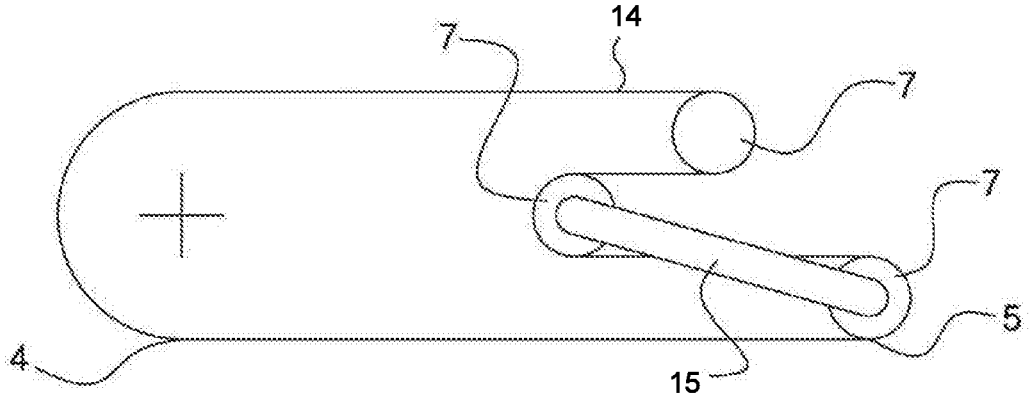
FIG. 1 is a diagram of an embodiment of a conveying device with variable geometry that is usable for the present invention.

With 1, overall a processing apparatus has been indicated (see FIG. 4) that comprises, in particular, at least one processing unit 2 that may be configured, for example, to separate portions of material from a continuous web of material. The processing unit 2 may be configured for receiving the material to be processed in the form of a single continuous web and for surrendering the processed material in the form of discrete portions separated from the continuous web. The processing unit 2 may comprise, in particular, at least one shearing unit with at least one shearing tool.

It is possible for the processing unit 2 to be of another type, in particular provided with other types of tool. The processing unit 2 could be configured, for example, for receiving material to be processed in the form of a single continuous web and for surrendering processed material still in the form of a single continuous web, or could be configured for receiving material to be processed in the form of a discrete portions arranged one after the other.

The processing apparatus 1 may be used, in particular, for actuating a method for the production of electrical energy storage devices. In particular, the processing apparatus 1 may be used for processing material (in the form of a web) comprising at least one separator for electrodes.

The processing apparatus 1 may comprise, in particular, at least one first conveying device 3 (upstream of the processing unit) that comprises at least one first inlet 4 for material and at least one first outlet 5 for material.

The first conveying device 3 may comprise, as in this embodiment, at least one first flexible element 6 (belt, chain, web, rope, cable, mat etc) that is slidable in a closed loop.

The first flexible element 6 may be arranged, in particular, for conveying the 13 material from the first inlet 4 to the first outlet 5. The first conveying device 3 may comprise, in particular, a driving arrangement (for example at least one first motor) for driving sliding of the first flexible element 6.

The first flexible element 6 may be configured, as in this embodiment, with variable geometry. The geometry of the first flexible element 6 may be so controlled as to vary at least the position of the first outlet 5 (the position of the first inlet 4 could remain fixed).

The first conveying device 3 may comprise, in particular, at least one first support system that supports the closed loop first flexible element 6. The first support system may comprise, in particular, at least one system of motion transmission members 7, for example members (pulleys) that are rotatable around their own rotation axis. This system may comprise, for example, at least one drive member connected to a drive shaft to command movement and/or one or more guide or transmission members that can rotate freely on their own axis.

The first support system may comprise a movable first portion 8 that is movable in a controlled manner to modify the geometry of the closed loop of the first flexible element 6 to maintain the length thereof substantially constant. The movable first portion 8 of the first support system may be arranged so as to vary the position of the first outlet 5. The movable first portion 8 may comprise, for example, a (stiff) connecting element that connects (integrally) the rotation axes of at least two motion transmission members 7. The movable first portion 8 may be connected to a driving system (with at least one motor, not shown) for controlling the movement of the movable first portion 8 and, consequently, the variation of the geometry of the closed loop of the first flexible element 6.

The first support system may be configured in such a manner that the movements of the first portion 8 (with consequent integral movement of the rotation axes of at least two motion transmission members 7) causes a variation of the geometry of the closed loop without modifying the length thereof. The first support system may be provided with a tensioning device (not shown) for controlling (maintaining constant) the tensioning of the first flexible element 6.

Figure 2:
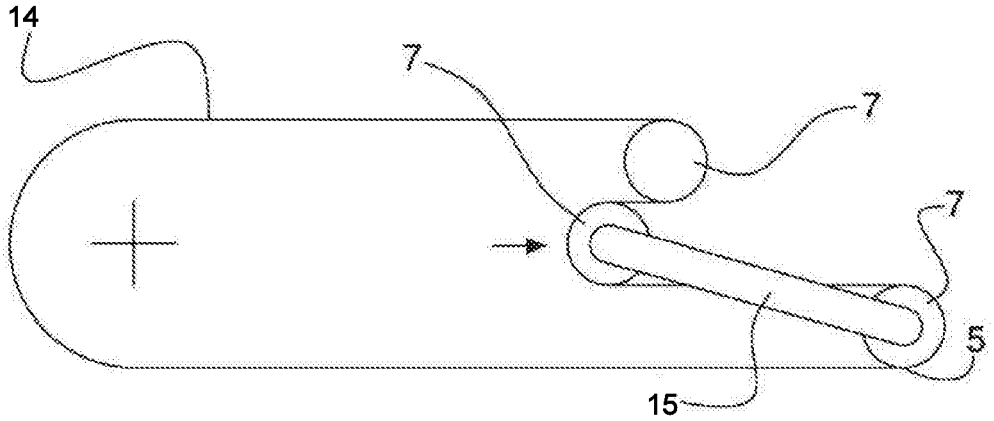
FIGS. 2 and 3 show the conveying device of FIG. 1 in two different operating configurations characterised by two different geometries.
Figure 3:
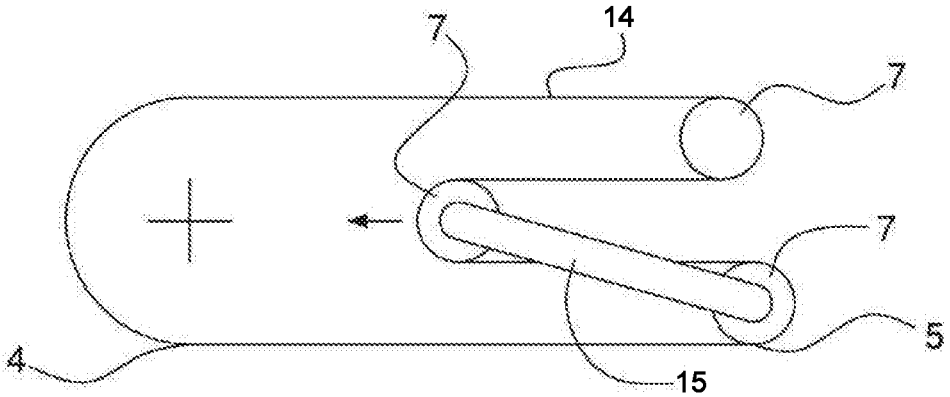

FIGS. 1 to 3 show three different positions of a movable portion 15 for a flexible element 14 of the first conveying device with three different geometries of the closed loop.

The processing apparatus 1 may be configured, in particular, so that the aforesaid processing unit 2 is arranged near the first outlet 5 for receiving the material coming from the first conveying device 3.

The processing unit 2 may be drivable, in particular, with the possibility of adopting at least one engagement position (schematised in FIG. 5B), for example a material cutting position, in which it engages the material. The processing unit 2 may be drivable, in particular, with the possibility of adopting at least one disengaged position (schematised in FIGS. 5A and 5C) in which it leaves the material free.

The processing unit 2 may be, as in this embodiment, movable together (integrally) with the first outlet 5.

The processing apparatus 1 may comprise, in particular, a control arrangement configured for controlling the movement of an assembly that comprises the processing unit 2 and the first outlet 5 and/or the movable first portion 8. In particular, the processing unit 2 may be connected to the movable first portion 8 so as to move integrally therewith. In the specific embodiment, the first portion 8 and the processing unit 2 are connected together by a mechanical connection, although it is possible to provide an electronic connection (by an electronic control arrangement).

The processing unit 2 may comprise, for example, a first end fixed to the rotation axis of at least one of the motion transmission members 7 on which the movable first portion 8 is constrained, such that the first portion 8 of the first support system may be integrally movable with the processing unit 2.

The processing apparatus 1 may comprise, in particular, at least one second conveying device 9 (downstream of the processing unit 2) that comprises at least one second inlet 10 for the material and at least one second outlet 11 for the material. The second conveying device 9 may comprise, as in this embodiment, at least one second flexible element 12 that is slidable in a closed loop and that may be arranged, in particular, for conveying the material from the second inlet 10 to the second outlet 11. The second flexible element 12 may be configured with variable controlled geometry, for example in such a manner as to vary the position of the second inlet 10 (the position of the second outlet 11 could remain fixed).

The processing unit 2 may be arranged, as in this embodiment, near the second inlet 10 to be able to deliver the material to the second conveying device 9. The processing unit 2 may be, in particular, integrally movable with the second inlet 10.

The second conveying device 9 may comprise, in particular, at least one second support system that supports the closed loop second flexible element 12. The second support system may comprise, as in this embodiment, at least one second portion 13 that is movable in a controlled manner and configured for modifying the geometry of the closed loop of the second flexible element 12 to maintain the length thereof substantially constant.

The movable second portion 13 may be arranged, as in this embodiment, in such a manner as to vary the position of the second inlet 13. The second portion 13 may be, in particular, integrally movable with the processing unit 2.

In particular, the aforesaid assembly, which comprises the processing unit 2 and the first portion 8 (together with the first outlet 5), may also comprise the second portion 13 (together with the second inlet 10).

The first conveying device 3 (upstream of the processing unit) may comprise, in particular, a third flexible element 14 that is slidable in a closed loop and that may comprise, as in this embodiment, a branch coupled with a branch of the first flexible element 6. The material advances, dragged by the first conveying device 3, passing between the aforesaid branch of the first flexible element 6 and the aforesaid branch of the third flexible element 14.

The third flexible element 14 may be configured, as in this embodiment, with variable controlled geometry, in particular with variation of geometry coordinated with the variation of geometry of the first flexible element 6.

The first conveying device 3 may comprise, in particular, at least one third support system that may support, as in this embodiment, the closed loop third flexible element 14. The third support system may comprise, in particular, at least one movable third portion 15 that is movable so as to modify the geometry of the closed loop of the third flexible element 14 to maintain the length thereof substantially constant. The movable third portion 15 may be arranged, as in this embodiment, in such a manner as to vary the position of the first outlet 5. The third portion 15 may be, in particular, integrally movable with the processing unit 2.

In particular, the aforesaid assembly, which may comprise the processing unit 2 and/or the first portion 8 (together with the first outlet 5) and/or the second portion 13 (together with the second inlet 10), may comprise the third portion 15.

The second conveying device 9 (downstream of the processing unit) may comprise, as in this embodiment, at least one fourth flexible element 16 that is slidable in a closed loop and that may comprise, in particular, at least one branch coupled with at least one branch of the second flexible element 12. The material that advances, dragged by the second conveying device 9, may pass between the aforesaid branch of the second flexible element 12 and the aforesaid branch of the fourth flexible element 16.

The fourth flexible element 16 may be configured, as in this embodiment, with variable geometry in which the variation of geometry may be, in particular, controlled in coordination with the variation of the geometry of the second flexible element 12.

The second conveying device 9 may comprise, in particular, a fourth support system that supports the closed loop fourth flexible element 16. The fourth support system may comprise, as in this embodiment, a fourth portion 17 that is movable so as to modify the geometry of the closed loop to maintain the length thereof substantially constant. The movable fourth portion 17 may be arranged, in particular, in such a manner as to vary the position of the second inlet 10.

The fourth portion 17 may be, in particular, integrally movable with the movement of the processing unit 2.

In particular, the aforesaid assembly, which may comprise the processing unit 2 and/or the first portion 8 (together with the first outlet 5) and/or the second portion 13 (together with the second inlet 10) and/or the third portion 15 (together with the first outlet 5), may comprise the fourth portion 17.

The second support system and/or the third support system and/or the fourth support system may each be configured in an analogous manner to the first support system disclosed above.

In particular, the movable second portion 13 and/or the movable third portion 15 and/or the movable fourth portion 17 may each comprise, a (stiff) connecting element that connects (integrally) the rotation axes of at least two motion transmission members of the support system of the respective second and/or third and/or fourth flexible element. The processing unit 2 may comprise, for example, a second end and/or a third end and/or a fourth end fixed to the rotation axis of at least one of the motion transmission members to which the second 1*s* portion 13 and/or the third portion 15 and/or the fourth portion 17 is constrained.

The control arrangement may be configured for controlling the sliding of the first flexible element 6 (in particular the rotation of the driving member for driving the support system of the first flexible element 6) and/or driving the processing unit 2 (in particular the movements between the aforesaid positions of engaging the material, or work positions, and positions of disengagement from the material, or rest positions).

In particular, the control arrangement may be configured for controlling, in a coordinated manner, the sliding of the first flexible element 6 (in particular the rotation of the driving member for driving the system of motion transmission members 7), the driving of the processing unit 2 (in particular the moving of the processing tool between the work and rest positions) and the movement of the aforesaid assembly comprising the processing unit 2 and/or the movable first portion 8 (in particular the movement that determines both the variation of the geometry of the closed loop, and the forward and/or backward movements of the processing unit 2) and/or one or more of the other movable portions 13, 15, 17.

In particular, the control arrangement may be configured for controlling the sliding of the second flexible element 12 in a coordinated manner with the sliding of the first flexible element 6, the drive of the processing unit 2 and the movement of the aforesaid assembly.

The control arrangement may comprise, in particular, a programmable electronic control device 20 (for example an electronic processor) and computer program instructions that are implementable on the electronic control arrangement.

The control arrangement may be configured, in particular, to perform a work cycle in which the material advances continuously in an advancement direction (through the effect of the sliding of the first flexible element). The work cycle may comprise, as in this embodiment, at least one forward step in which the processing unit advances in the advancement direction and at least one return step in which the processing unit moves backward in the opposite direction.

Figure 5:
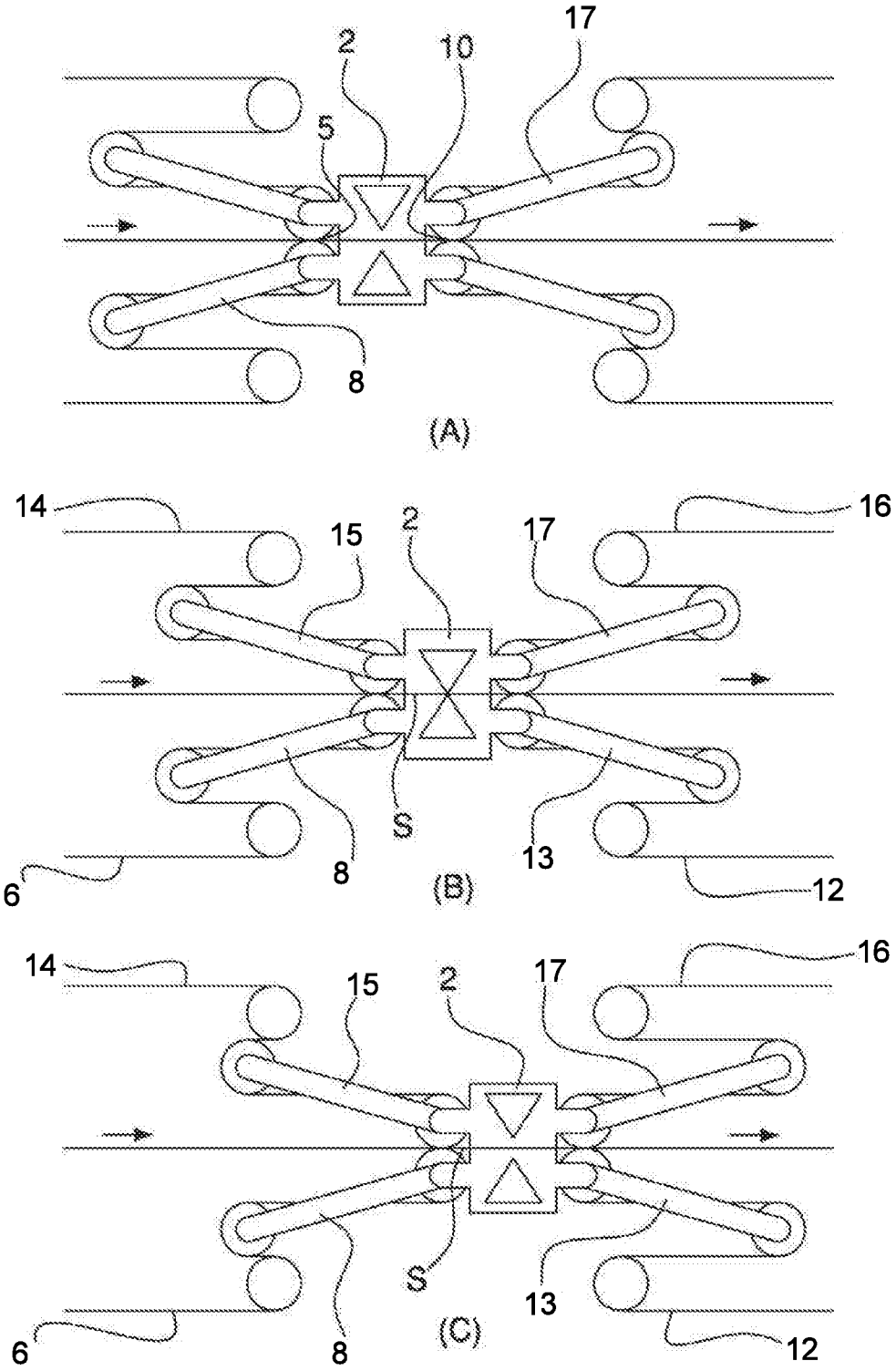
FIGS. 5A to 5C show a part of the processing apparatus of FIG. 4 in three different successive operating sequences.

In FIGS. 5A to 5C three different moments of the forward step are illustrated, in which the assembly that comprises the processing unit 2 advances together with the material S (at the same speed, at least for a considerable portion of the forward step) with an initial moment (FIG. 5A), an intermediate moment (FIG. 5B) and a final moment (FIG. 5C). The return step (not illustrated) involves moving backward the aforesaid assembly, from the position of FIG. 5C to that of FIG. 5A, in a direction opposite the material advancement direction S that meantime continues to advance (in particular at a constant advancement speed for at least one portion).

The (programmed) work cycle may provide, as in this embodiment, for the processing unit 2 adopting the engagement position (FIG. 5B) during at least one part of the forward step and adopting the disengaged position (FIGS. 5A and 5C) during at least one part of the return step (in particular during the entire return step). The control arrangement may control in a coordinated manner the sliding of the first flexible element 6 (and/or of the second flexible element 12 and/or of the third flexible element 14 and/or of the fourth flexible element 16), the drive of the processing unit 2 and the movement of the processing unit 2 (together with the rest of the assembly), so that the processing unit 2 can engage the material S whilst the processing unit 2 advances at the same speed as the material S.

The apparatus may be so controlled that the separated (cut) material advances, at least for a period of time, at a speed that is greater than the rest of the material. It is possible, for example, to accelerate the sliding of the first flexible element 6 (and/or of the third flexible element 14) and/or slow the sliding of the second flexible element 12 (and/or of the fourth flexible element 16), for a certain (relatively short) period of time, immediately after the processing unit has carried out the separation (shearing) and the processing unit assumes the disengaged position of the material, in particular to space the separated material apart from the rest of the material.

In particular, the material S may be commanded to advance at a constant forward speed for at least one part of the forward step and/or to move backwards at a constant return speed for at least one part of the return step. The assembly (comprising the processing unit 2) may be commanded to advance at the same speed of the material S in at least one part of the forward step and to move backwards in the return step at a greater return speed (to recover the same initial position of the preceding work cycle) with respect to the speed of the forward step.

In the forward step (in which the processing unit 2 can perform processing of the material S) the processing unit 2 may then advance for at least one portion at the same speed as the material S, so that it can process the material S, whilst the latter advances, minimising, or substantially reducing to zero, the relative speed between the processing unit 2 and the material S in the advancement direction.

In particular, it is possible to provide, as in this embodiment, for the first inlet 4 to remain fixed. In particular, it is possible to provide, as in this embodiment, for the second outlet 11 to remain fixed. In this manner the supply of the material to be processed and/or the evacuation of the processed material is particularly facilitated.

More in particular, the first conveying device 3 (upstream of the processing unit 2) may comprise an outlet for the material (first outlet 5) that, during advancement of the processing unit 2 in the forward step, may be moved together with the processing unit 2 so as to remain at the same distance from the processing unit 2. More in particular, the first conveying device 3 may comprise an outlet for the material (first outlet 5) that, during moving backwards of the processing unit 2 in the return step, may be moved together with the processing unit 2 so as to remain at the same distance from the processing unit 2.

More in particular, the second conveying device 9 (downstream of the processing unit 2) may comprise an inlet for material (the second inlet 10) that, during advancement of the processing unit 2 in the forward step, may be moved together with the processing unit 2 so as to remain at the same distance from the processing unit 2. More in particular, the second conveying device 9 may comprise an inlet for material (the second inlet 10) that, during moving backwards of the processing unit 2 in the return step, may be moved together with the processing unit 2 so as to remain at the same distance from the processing unit 2.

The first conveying device 3 (upstream of the processing unit 2) may comprise an inlet for material (first inlet 4) that, during advancement of the processing unit 2 in the forward step, may always remain fixed in the same position. The first conveying device 3 may comprise an inlet for material (first inlet 4) that, during moving backwards of the processing unit 2 in the return step, may always remain fixed in the same position.

The second conveying device 9 (downstream of the processing unit 2) may comprise an outlet for the material (second outlet 11) that, during advancement of the processing unit 2 in the forward step, may always remain fixed in the same position. The second conveying device 9 may comprise an outlet for the material (second outlet 11) that, during moving backwards of the processing unit 2 in the return step, may always remain fixed in the same position.

Instead of the first conveying device 3 upstream of the processing unit 2, it is possible to use any other conveying device comprising, in particular, a first inlet for material (for example a fixed position inlet) for the material and a first outlet that may be moved (with a forward and backward motion) integrally with the processing unit 2. Instead of the second conveying device 9 downstream of the processing unit 2, it is possible to use any other conveying device comprising, in particular, a second inlet that may be moved (with a forward and backward motion) integrally with the processing unit 2 and a second outlet (for example a fixed position outlet).

In the first conveying device 3 (and/or in the second conveying device 9) the material is conveyed by friction, in particular by passing through two coupled branches of two slidable elements that cooperate together. It is nevertheless possible to use other types of conveying devices, for example with a single (in particular closed loop) sliding element, for example a conveyor belt, or a conveyor of the suction type, or yet other types.

Figure 4:
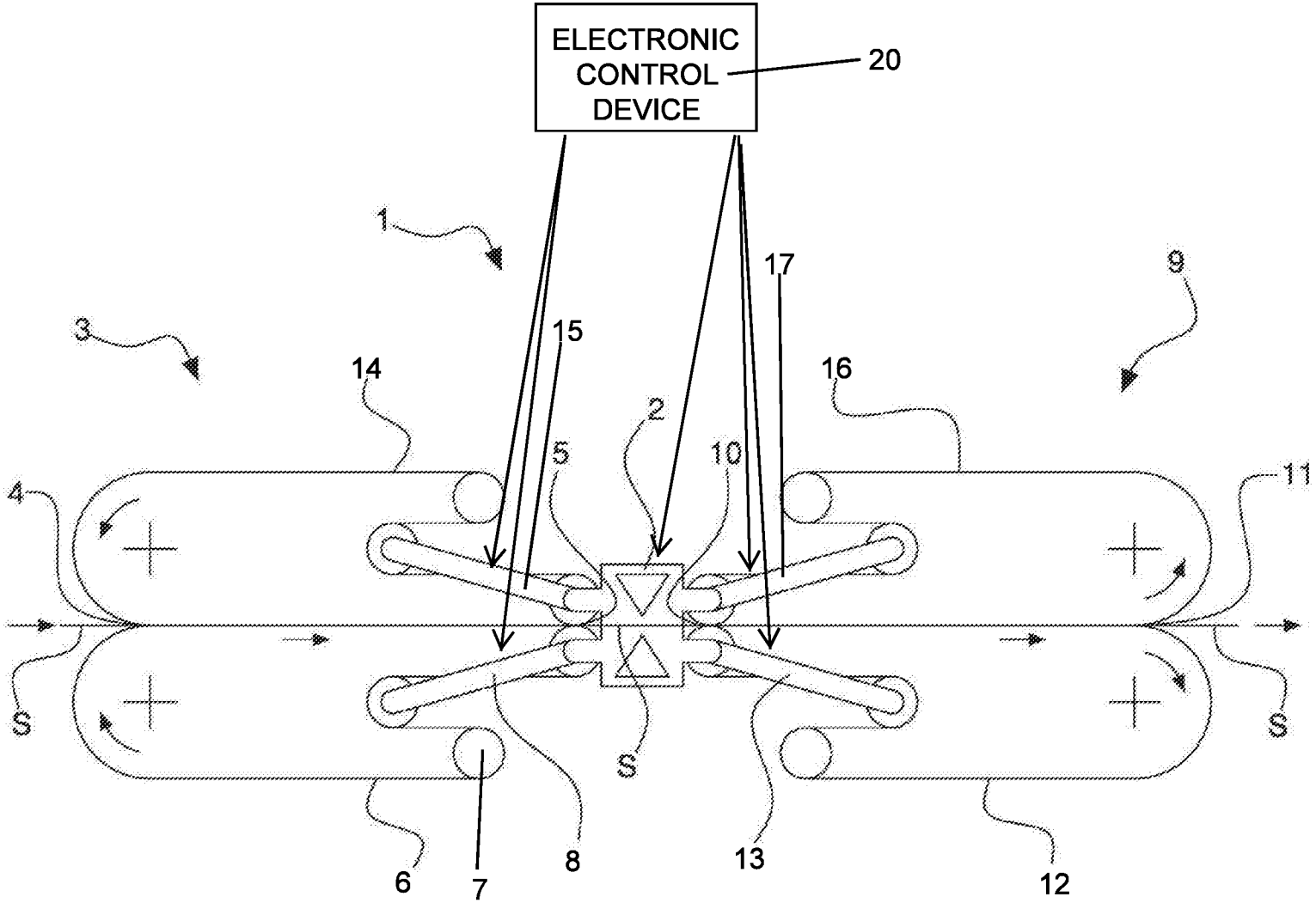
FIG. 4 is a diagram of an embodiment of a processing apparatus made in accordance with the present invention and which uses various conveying devices, each of which is made as in FIGS. 1 to 3.

It is possible to provide another embodiment, not shown, in which the two flexible elements 6 and 12 of the example of FIG. 4 are integrated with each other (for example, joining the two upper branches in FIG. 4) so as to form a single closed loop flexible element defining both the first outlet 5 and the second inlet 10 (a single closed loop element defines the two inlets 4 and 10 and the two outlets 5 and 11).

It is also possible to provide, in addition or alternatively, that the two flexible elements 14 and 16 of the example of FIG. 4 are integrated with each other (for example by joining the two lower branches in FIG. 4) so as to form a single closed loop flexible element that defines both the first outlet 5 and the second inlet 10 (a single closed loop element defines the two inlets 4 and 10 and the two outlets 5 and 11).

The invention claimed is:

1. Processing apparatus comprising:

a first conveying device including a first inlet, a first outlet and an endless slidable first flexible element arranged for conveying material from said first inlet to said first outlet, said first flexible element being supported by a first portion of a support configured with variable geometry that is controlled to vary at least the position of said first outlet;

said first conveying device including first support system that supports said first flexible element and that includes a first portion that is movable in a controlled manner to modify the geometry of said first flexible element while maintaining it length substantially constant, said first portion of said first support system being arranged to vary the position of said first outlet a processing unit arranged adjacent to said first outlet for receiving the material from said first conveying device, said processing unit being drivable with said first portion of said first support system between at least one engagement position in which it engages the material and at least one disengagement position in which it disengages the material, said processing unit being movable together with said first outlet; and a control arrangement configured to coordinate and control the sliding of said first flexible element, said processing unit being driven and moved together with said first outlet, to perform a processing cycle in which the material advances in a continuous manner in a forward direction, wherein said processing cycle includes at least one forward step in which said processing unit advances in said forward direction together with said first outlet and at least one return step in which said processing unit retracts in the opposite direction together with said first outlet, and further wherein said processing unit is arranged in said engagement position during at least a part of said forward step to engage the material as it advances with the same material and said processing unit is arranged in said disengagement position during at least a part of said return step.

2. Apparatus according to claim 1, and further comprising a second conveying device including a second inlet, a second outlet and an endless slidable second flexible element arranged for conveying material from said second inlet to said second outlet and that is configured with variable geometry that is controlled to vary the position of said second inlet.

3. Apparatus according to claim 2, wherein said processing unit is arranged adjacent to said second inlet to deliver the material to said second conveying device.

4. Apparatus according to claim 2, wherein said processing unit is movable together with said second inlet.

5. Apparatus according to claim 2, wherein said second conveying device includes a second support system that supports said second flexible element and includes a second portion that is movable in a controlled manner to modify the geometry of said second flexible element while maintaining its length substantially constant, said second portion being arranged to vary the position of said second inlet.

6. Apparatus according to claim 5, wherein said second portion moves together with said processing unit.

7. Apparatus according to claim 2, wherein said second conveying device includes an endless slidable fourth flexible element that includes a branch coupled with a branch of said second flexible element, wherein the material passes between said branches of said second and fourth flexible elements, respectively.

8. Apparatus according to claim 7, wherein said fourth flexible element is configured with variable geometry that is controlled in coordination with said second flexible element.

9. Apparatus according to claim 7, wherein said second conveying device includes a fourth support system that supports said fourth flexible element and includes a fourth portion that is movable to modify the geometry of said fourth flexible element while maintaining its length substantially constant, said fourth portion being arranged to vary the position of said second inlet.

10. Apparatus according to claim 9, wherein said fourth portion moves together with said processing unit.

11. Apparatus according to claim 1, wherein said first conveying device includes an endless slidable third flexible element that includes a branch coupled with a branch of said first flexible element, wherein the material passes between said branches of said first and third flexible elements, respectively.

12. Apparatus according to claim 11, wherein said third flexible element is configured with variable geometry that is controlled in coordination with said first flexible element.

13. Apparatus according to claim 11, wherein said first conveying device includes a third support system that supports said third flexible element and includes a third portion that is movable to modify the geometry of said third flexible element while maintaining its length substantially constant, said third portion being arranged to vary the position of said first outlet.

14. Apparatus according to claim 13, wherein said third portion moves together with said processing unit.

15. Apparatus according to claim 1, wherein said at least one processing unit is configured to separate portions of the material from material in the form of a continuous strip.

16. Apparatus according to claim 15, wherein said control arrangement is configured so that the separated portion of material advances, after separation, at a higher speed than remainder of the material, to space the separated portion from the remainder of the material.

17. Apparatus according to claim 15, wherein said at least one processing unit comprises at least one shearing unit.

18. Method for the production of electrical energy storage devices which uses a processing apparatus according to claim 1 for processing material, comprising at least one separator for electrodes.

* * * * *